US005537782A

United States Patent [19]

Klippert et al.

[11] Patent Number: 5,537,782

[45] Date of Patent: Jul. 23, 1996

[54] ELECTRICALLY-OPERATED DISPLACEMENT DEVICE FOR WINDOWS OR SLIDING ROOFS OF MOTOR VEHICLES

[75] Inventors: Uwe Klippert, Oberaula; Detlev Backert, Coburg; Klaus Wagner, Gleussen; Klaus Leidner, Sesslach; Carsten Brandt, Weidach, all of Germany

[73] Assignee: Brose Fahrzeugteile GmbH & Co. KG, Coburg, Germany

[21] Appl. No.: 326,866

[22] Filed: Oct. 21, 1994

[30] Foreign Application Priority Data

Nov. 24, 1993 [DE] Germany ..... 43 40 013.2

[51] Int. Cl.[6] ..... E05F 11/00

[52] U.S. Cl. ..... 49/358

[58] Field of Search ..... 49/348, 349, 358; 296/223

[56] References Cited

U.S. PATENT DOCUMENTS

| | | | |
|---|---|---|---|
| 4,167,834 | 9/1979 | Pickles | 49/358 |
| 4,612,729 | 9/1986 | Sato | 49/358 X |
| 4,908,988 | 3/1990 | Yamamura et al. | 49/358 |
| 4,939,867 | 7/1990 | Harada et al. | 49/358 X |
| 4,967,510 | 11/1990 | Torii et al. | 49/358 |
| 4,970,827 | 11/1990 | Djordjevic | 49/349 |
| 4,991,348 | 2/1991 | Yamamura et al. | 49/358 X |

FOREIGN PATENT DOCUMENTS

| | | |
|---|---|---|
| 490341A | 12/1991 | European Pat. Off. . |
| 1244610 | 7/1967 | Germany . |
| 1926800 | 11/1970 | Germany . |
| 2928948 | 1/1980 | Germany . |
| 3209171 | 10/1982 | Germany . |
| 4026214 | 2/1992 | Germany . |

*Primary Examiner*—Jerry Redman
*Attorney, Agent, or Firm*—Christie, Parker & Hale

[57] ABSTRACT

A displacement device for use with windows and sliding roof for motor vehicles includes a toothed rack disposed within the vehicle in a direction parallel to the displacement direction. A motor-gear housing is positioned adjacent the toothed rack and includes an electrical driver, a central shaft positioned perpendicular to the rack, and a pinion gear on the shaft that is engaged with the toothed portion of the rack. The rack and housing include guide surfaces that are positioned to correspond with one another. A guidance element is attached to the housing and the rack is interposed between the guide surfaces of the housing and the guidance element to control and guide the movement of the housing vis-a-vis the rack during activation of the electrical drive. Attachments extend from the housing and are configured to accommodate placement of an edge portion of a window therein. A flexible ribbon-like electrical power cable extends from the housing in a direction parallel with the window and rack and is configured in a loop to minimize the space required within the vehicle for displacement operation of the housing and window.

19 Claims, 5 Drawing Sheets

10
11
1
3
6
6
20
22
2
4
4
21
8
3
11

Fig. 3a
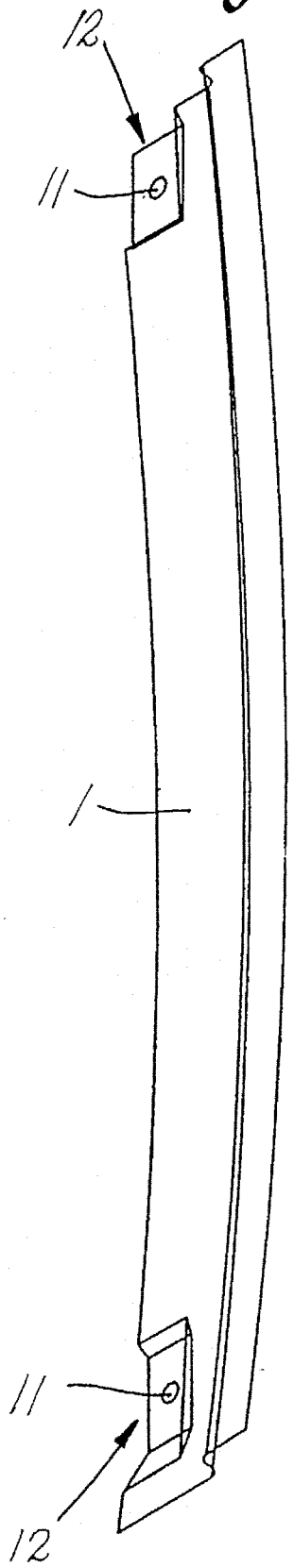
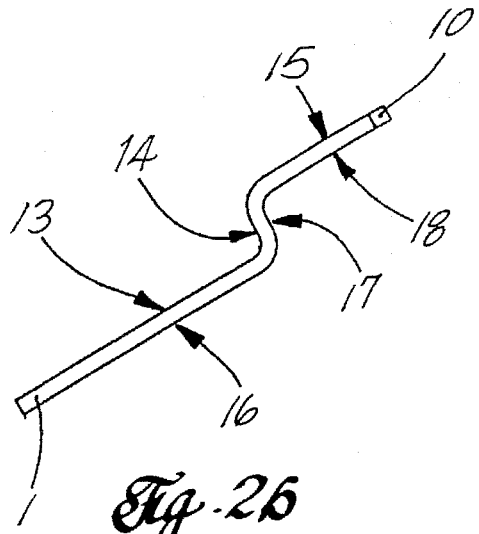
Fig. 2b

ELECTRICALLY-OPERATED DISPLACEMENT DEVICE FOR WINDOWS OR SLIDING ROOFS OF MOTOR VEHICLES

FIELD OF THE INVENTION

The invention relates generally to device used to effect displacement of motor vehicle windows or sliding roofs and, more particularly to an electrically-operated displacement device.

BACKGROUND OF THE INVENTION

An electrically-operated window lift is known from German Patent Publication DE 12 44 610, which allows lowering the window of a motor vehicle along a curved track. In the process, guide rollers disposed in the vicinity of the area of lower corners of the window engage a profiled section of guide rails which are associated with them. A further, third guide rail is located in the central area of the door and supports a toothed rack which is in engagement with teeth of a power take-off pinion of a motor-gear unit. The third guide rail is also curved, therefore, the motor-gear unit must perform a translatory movement along the lower edge of the window during raising and lowering of window. The translatory movement of the motor-gear unit is assured by means of a slide rail connected with the lower edge of the window.

With its three guide rails and the sliding rail for the motor-gear unit, the described window lift has a relatively elaborate design. In addition, the construction of the center guide rail having the toothed rack on one leg of the profiled section and the sliding edge on the other leg of the profiled section is not very well suited for efficient production. During inclement weather there is a large chance of icing of the slide rail supporting the motor-gear unit, which could prevent the operation of the window.

German Patent Publication DE 19 26 800 describes a window lift device having a toothed rack drive, wherein the toothed rack is guided in a profiled window guidance section. In this case, the toothed rack is preferably embodied in one piece with the guide rail. This very simple design integrates the tasks of force transmission and window guidance in only one component, because of which a high degree of compactness is attained, along with the use of only a few individual parts. However, its disadvantage lies in that the position of the drive which is fixedly connected with the frame and cannot be freely selected. The connection of a drive pinion with tooth elements of the toothed rack must always be disposed closely below the door cavity which, however, when an electrical drive is used, quickly leads to problems because of the reduced availability of space at this location. In addition, the proposed solution is not suitable in connection with windows without a lateral frame which can house the toothed rack.

German Patent Publication DE 40 26 214 A1 and European Patent Publication EP 0 490 341 A1 describe operating devices which employ spindles, which also permit a compact design. The poor efficiency of spindle drives must be considered disadvantageous. If strongly curved windows are used, it is necessary to employ expensive flexionally elastic spindles. The noise problems connected with spindle drives are often hard to overcome, because the spindle itself cannot perform any guidance tasks.

A further window lift system with a motor seated at the lower edge of the window and a drive rod disposed obliquely in the door is disclosed by Japanese Patent Publication JP 4-155 083A. The power supply is shown to be a screw-shaped cable extending from the motor into a lower corner area of the door. In the course of the movement of the window between its upper and lower stops, the cable crosses a large section of the door area, so that a relatively large space must be kept free for the cable. In addition, it is possible that, when the door is slammed shut, undesirable noises are caused by the unfastened sections of the cable.

It is, therefore, the object of the invention to develop an electrically-operated displacement device for windows or sliding roofs of motor vehicles, employing a toothed rack drive system and guidance system, which is distinguished by a high degree of compactness and by cost-effective manufacture, which can be easily adapted to the various requirements of different door configurations. It is desired that the device be formed from a small number of individual parts. It is also desired that guidance system employed by such device not reduce the free space required for other components, such as speakers or the like.

SUMMARY OF THE INVENTION

An electrically-operated displacement device for effecting the displacement of a window or sliding roof of a motor vehicle is constructed according to principles of this invention that employs a toothed rack drive system and a guidance system that is compact in design, is made from a small number of individual parts, and is cost-effective to manufacture. A displacement device comprises a rack disposed in a displacement direction within a body portion of a vehicle. The rack includes a toothed portion extending along one edge that extends along the displacement direction. The rack also includes attachment points positioned at opposite end portions that define the displacement direction that accommodate attachment of the rack with an adjacent portion of the vehicle body.

The device includes a motor-gear housing positioned adjacent to the rack which includes an electrical drive, a central shaft positioned having an axis perpendicular to the rack, and gears connecting the electrical drive to the shaft. The shaft includes a pinion gear that extends a distance from the housing and engages the toothed portion of the rack. A flexible electrical power line extends from the housing in a direction parallel with the window. The housing is formed from two half portions that are attached together by releasable fittings. A housing half portion disposed adjacent the rack includes guide surfaces to engage the surface of the rack during operation and, thereby, provide guidance of the housing along the rack during operation. The housing also includes window attachments that extend away from the housing in the displacement direction that are configured to accommodate placement of a window edge portion therein.

The device comprises a guide element that is attached to the half portion of the housing adjacent the rack, thereby serving to sandwich the rack between the guide surfaces of the housing and the guide element. The guide element is attached to the housing by a threaded portion of the shaft that extends through a hole in the guide element and is threadably engaged by a nut. The combination of the guide surfaces of the housing and the guide element serves to control and guide the displacement of the housing along the rack during activation of the electrical drive.

BRIEF DESCRIPTION OF THE DRAWINGS

These and other features and advantages of the present invention will become appreciated as the same becomes better understood with reference to the specification, claims and drawings wherein:

FIG. 2*b* is a horizontal cross-sectional detailed side view of the toothed rack of FIG. 4, illustrating a Z-shaped profile;

DETAILED DESCRIPTION OF THE INVENTION

FIGS. 1*a*–l*c* illustrate different views of a preferred embodiment of a displacement device constructed according to principles of this invention. A large portion of the exterior characteristics of the displacement device can be seen in the perspective view of FIG. 1*c*. The device includes a toothed rack 1 having a number of different angled portions and has a Z-shaped cross section that is more clearly shown in FIG. 2*b*. The angling of the toothed rack serves to increase the structural rigidity of the rack and is also mainly used to provide guide surfaces which can absorb forces acting at an angle in respect to the displacement direction. In the simplest case the toothed rack has an angled section in the edge area located opposite the teeth, so that there is an L-shaped profile cross section. Particularly good guidance properties are achieved by means of a Z-shaped profile cross section. In addition, those areas which are not covered by the guidance means can have attachment points for connecting the toothed rack with a door portion of the vehicle body.

Figure 3:
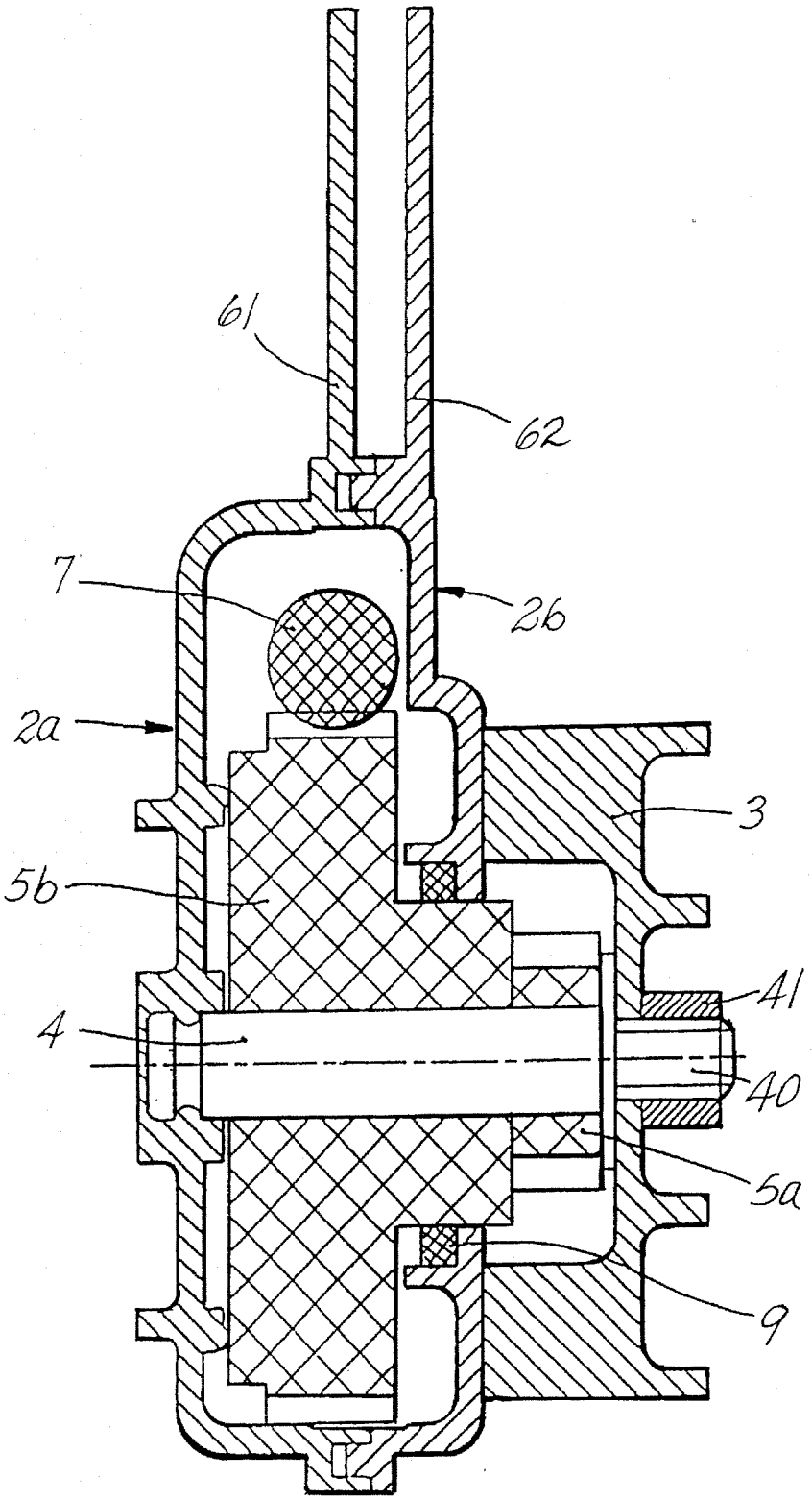
FIG. 3 is a vertical cross-sectional side view through section 3–3 of the displacement device of FIG. 1*a* without the toothed rack.
Figure 4:
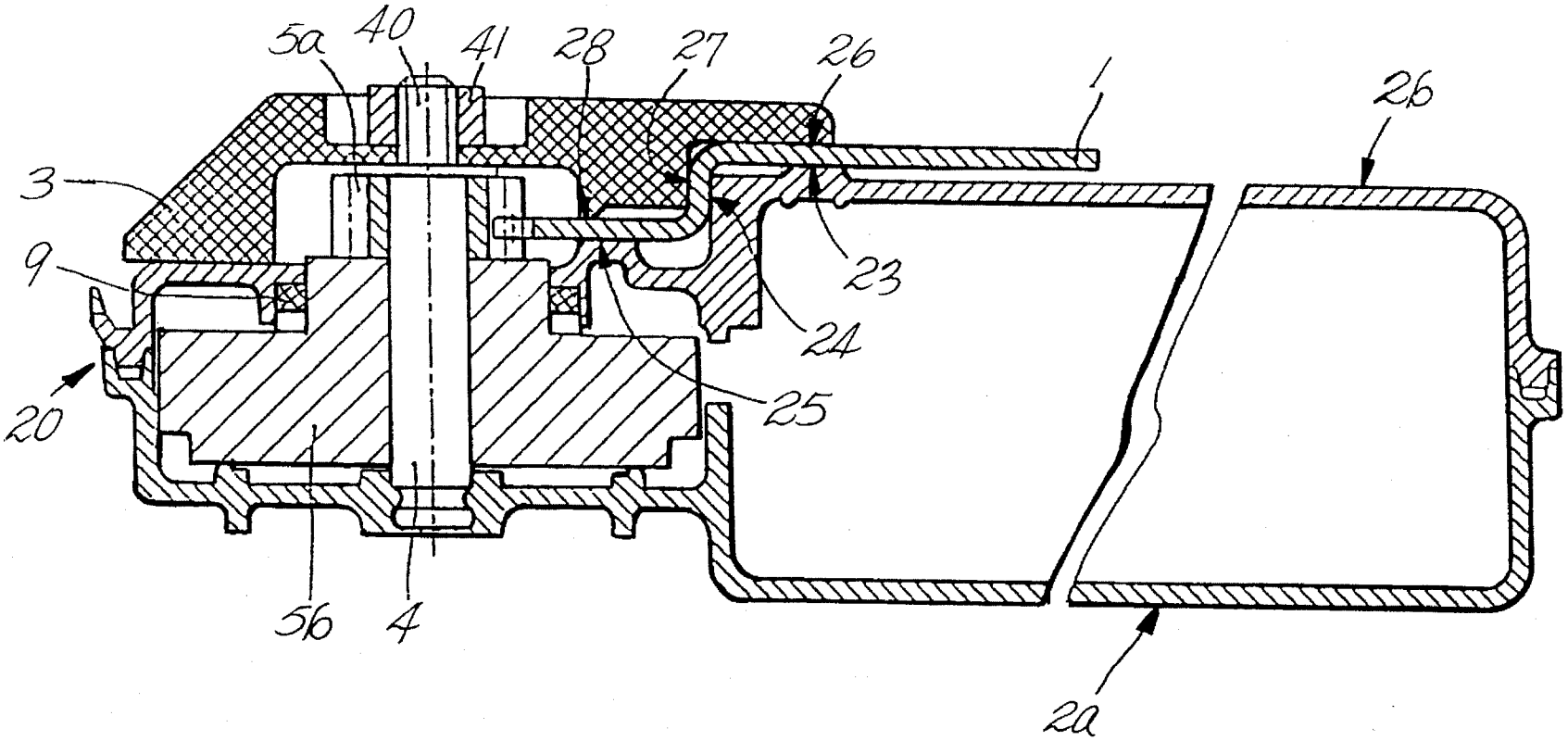
FIG. 4 is a horizontal cross-sectional side view through the displacement device in the area of the gear shaft in accordance with section 4–4 of FIG. 1*a*.

Teeth 10 have been worked into the one edge area of the profiled sheet metal section forming the toothed rack 1, which are in engagement with a pinion 5*a* (best shown in FIGS. 3 and 4). The rack 1 includes attachment holes 11 that extend through the sheet metal forming the rack and are positioned opposite one another at other edge areas of the rack and are used to fix the toothed rack via spacers to an adjacent sheet metal portion of the door (not shown). The toothed rack is used to transfer rotational movement of the pinion 5*a* to vertical movement of moving parts 2 and 3.

In addition to its use as force transfer element, the toothed rack 1 is also used for guiding the window vertically within the door. For this purpose, the toothed rack 1 comprises a number of guide surfaces 13, 14, 15, 16, 17, 18 (shown in FIG. 2*b*) which, in cooperation with the guide surfaces 23, 24, 25, 26, 27, 28 (shown in FIG. 4) of the moving parts 2 and 3 (shown in FIGS. 1*a*–l*c*) that act to absorb those forces which occur at an angle to the direction of displacement of the window. The guide surfaces 13, 14, 15 and 16, 17, 18 extend on both sides along the toothed rack 1 and are located directly opposite the corresponding guide surfaces 23, 24, 25 and 26, 27, 28 of the moving parts 2*b*, 3. This is particularly clearly visible when observing FIGS. 2*b* and 4 in combination.

As mentioned above, the rack is configured having at least one angular section when viewed in cross section along the displacement direction. Preferably, attachment points 11 are positioned at opposite end portions of the rack at a portion of the rack that is not planer with the toothed portion. It should be pointed out here that the toothed rack can be made from any type of structurally rigid material such as sheet steel, aluminum, zinc diecast or the like. The selection of the material essentially depends on the requirements of the respective intended use.

The moving part of the displacement device includes an electrical drive, a worm drive 7 attached to a drive shaft of the electrical drive, a worm wheel 5*b* in geared engagement with the worm drive, a pinion 5*a* mounted concentrically to the worm wheel, and flexible electrical lines 8. The electrical drive, worm drive, worm wheel, and pinion are placed in a common housing 2 formed from two housing half-shells 2*a*, 2*b*. Two legs 61 and 62 extend from the an upper portion of the housing half-shells 2*a* and 2*b*, respectively, and are parallel with the surface of the window. Together with associated stop elements 60, which are associated with stop openings in the window, the legs 61 and 62 form particularly simple window attachments 6. The legs 61 and 62, which open slightly conically upward, provide for problem-free insertion of the lower edge of the window into each window attachment. If desired, additional locking elements can be provided for securing the window attachment. The integration of the window attachment into the housing of the motor-gear unit is also advantageous for further increasing the degree of compactness of the device.

The housing half-shells 2*a* and 2*b* are connected together by a plurality of clip connections 20 that extend from one half-shell and are configured to accommodate releasable attachment with a complementary clip portion formed on the other half-shell. The clip connections are distributed evenly around the housing and provide a simple and cost-effective method of assembling the housing 2.

A motor area 21 of the housing 2 supports the electrical drive and a gear area 22 of the housing, adjacent the motor area 21, supports a central shaft 4 in one housing half-shell 2*a* and supports the worm wheel 5*b* and a pinion 5*a* meshing with the teeth 10 of the toothed rack 1. In addition, a separate guidance element 3 is supported by the central shaft 4 and is fastened to the housing half-shell 2*b* via a threaded stem portion 40 of the shaft and nut 41 to the housing half-shell 2*b*. By means of this it is possible to introduce the forces occurring between the toothed rack 1 and the guidance element 3 over the shortest path into the housing 2 via the central shaft 4. By means of the guidance element, an advantageous flow of force over the metallic gear shaft is assured and the otherwise necessary disadvantageous direction of force over large areas of the gear housing is prevented. The load-bearing capacity of the displacement device is increased as a result of this. Although the guidance element 3 is shown as a separate part, it can also be embodied as a one-piece component of the housing half-shell 2*b*, because of which the degree of integration of the displacement device in accordance with the invention is still further increased.

A sealing ring 9, is intended to prevent moisture from entering the housing 2 and is seated within housing half-shell 2*b* on a cylindrical section of the central shaft 4 between the pinion 5*a* and the worm wheel 5*b*. The force transmission between the electrical drive and the worm wheel 5*b* takes place via a worm drive 7 as shown in FIG. 3.

The embodiment of the guide surfaces 23 to 28, shown in FIG. 4, integrated into the housing half-shell 2*b* and the guidance element 3, is to be understood as a schematic representation. For example, it is not necessary that the guide surfaces 23 to 28 (as shown) be located in one sectional plane. Basically at least one pair of guide surfaces 23 and 26, and/or 25 and 28, which serve to absorb the forces acting perpendicularly to the surface of the window, and one pair of guide surfaces 24 and 27, which transmit the forces occurring parallel with the plane of the window, are required. Guide surfaces are integral with as least a portion of the outer profile of the housing, i.e., along an outside surface of housing half-shell 2*b*, for purposes of increasing the degree of integration of the displacement device, wherein these guide surfaces are assigned to the corresponding functional surfaces 13–18 of the toothed rack 1.

Because of the angling of the toothed rack, which preferably provides it with a Z-shaped profile cross section (as shown in FIG. 2*b*), in addition to the guide surfaces which act perpendicularly to the plane of the window further guide surfaces are created, which absorb forces parallel with the plane of the window and transversely to the direction of movement of the window. By means of this the described displacement device is suited to assure a precise window movement with the lowest outlay for parts. Because of the additional integration of the guidance tasks into the one-piece toothed rack, complicated track controls of the window can also be effected.

Because the motor-gear unit housing is connected with the lower edge of the window it must always follow the displacement movement of the window and the problem of too large a space requirement for guiding electrical cables often occurs. For this reason the invention provides for the use of a flexible ribbon cable 8 which extends in the shape of a loop between the motor-gear unit housing and its attachment on the door, wherein the plane of the ribbon cable is essentially disposed parallel to the window. If needed, the said cable also contains lines for electronic and sensing devices. In accordance with a preferred embodiment, the cable is passed through the area of the seal between the two shells of the drive housing, where it is also sealed against moisture. The required electrical contacts are provided inside the housing, for example by soldered spots or by means of cutting-and clamping techniques. Thus, plug connections are not necessary at this place.

The flexible, ribbon-like power supply lines 8 penetrate the lower sealed area of the housing 2 between the housing half-shells 2*a* and 2*b* without the use of a plug connection. The ribbon-like power supply lines 8 forms a loop between its points of attachment which is, depending on the position of the window, embodied to be more or less stretched. The electrical supply lines 8 requires only little space within the body of the door, because of which more space is available for other components such as audio speakers or the like.

The device is operated to effect the displacement of a window of a vehicle by activating the electrical drive, thereby effecting rotation of the worm gear 7, worm wheel 5*b*, central shaft 4 and pinion 5*a* that engages the toothed portion 10 of the rack 1. Accordingly, rotation of the pinion 5*a* against the toothed portion 10 causes the housing 2 and the window attached to the housing via the attachments 6 to be displaced upwardly or downwardly vis-a-vis the rack. As the housing is displaced, the corresponding guide surfaces of the rack and housing, and the guidance element, serves to control and guide the movement of the housing about the rack to provide controlled movement of the window within the vehicle body.

An advantageous alternative embodiment of the toothed rack 1 is represented in FIG. 2*a*. In the alternative embodiment, the attachment points 12 are stamped-out of the plane of the rack 1 to make possible a connection between the sheet metal of the door and the toothed rack 1 without having to employ spacers. However, care must be taken that the guide surfaces of the housing 2 or the guidance element 3 which correspond with the guide surfaces 13 and 16 do not collide with the attachment points, because otherwise the possible lift would be correspondingly limited.

Additionally, although embodiments of the electrically-operated displacement device have been described and illustrated for use in effecting the displacement of a vehicle window that is housed within a door, it is to be understood that other uses of the displacement device are within the scope of this invention. For example, the electrically-operated displacement device can be used to effect the displacement of sliding roofs in a vehicle. In such an application, the displacement device described and illustrated above is installed within a roof portion of the vehicle and the attachments 6 are configured to accommodate attachment with and end portion of a sliding portion of the roof. Movement of the moving parts 2 and 3 of the device vis-a-vis the toothed rack 1 effects slidable movement of the sliding roof portion within the vehicle roof to open and close an opening in the roof.

The disclosure of attached German patent application Serial No. P 43 40 013.2, filed on Nov. 24, 1993, is incorporated fully herein by reference. Priority of this German patent application is claimed.

Although preferred embodiments of an electrically-operated displacement device for windows or sliding roofs or motor vehicles have been specifically described and illustrated, it is to be understood that variations or alternative embodiments apparent to those skilled in the art are within the scope of this invention. Since many such variations may be made, it is to be understood that within the scope of the following claims, this invention may be practiced otherwise than specifically described.

What is claimed:

1. An electrically-operated displacement device for a closure member of a motor vehicle body, the device comprising:

a rack extending in a displacement direction, wherein the rack is a one-piece member having a toothed portion extending along an edge portion and includes attachment points that are adapted for connection with the vehicle body, wherein the rack has at least one angled section extending in the displacement direction, wherein the rack includes a number of guide surfaces along a surface portion, and wherein the rack transfers displacement force to the closure member and guides the closure member during operation of the device;

a motor-gear housing comprising an electrical drive having a drive element in engagement with the toothed portion of the rack and having a flexible electrical power line, wherein a portion of the housing adjacent a surface of the rack includes a number of integral guide surfaces positioned to correspond with the guide surfaces of the rack; and a guidance element attached to the housing having guide surfaces positioned adjacent to a surface of the rack opposite from the housing, wherein the guide surfaces of the housing and the guide surfaces of the guidance element together partially surround the rack to accommodate movement of the housing and guidance element along the rack past the attachment points.

2. The displacement device as recited in claim 1 wherein the rack has an angled section having a Z-shaped cross section.

3. The displacement device as recited in claim 1 wherein the rack includes attachment points that are positioned at opposite end portions of the rack that define the displacement direction, and wherein the attachment points are deformed out of a plane defined by the rack and are attached to an adjacent portion of a vehicle body.

4. The displacement device as recited in either claim 1 or 3 wherein the rack comprises an unguided section opposite from the toothed portion that is not covered by the guidance element.

5. The displacement device as recited in claim 1 wherein the rack is interposed between the guide surfaces of the housing and the guidance element, and wherein the guide surfaces of the housing and guidance element act to guide and control a path of the housing on the rack during operation.

6. The displacement device as recited in claim 1 comprising a closure member attachment integral with the housing, wherein the closure member attachment is configured to accommodate placement of an edge portion of the closure member therein.

7. The displacement device as recited in claim 1 wherein the housing comprises a central shaft disposed therein extending within the housing perpendicular to the rack, wherein the central shaft comprises a pinion gear that is engaged with the toothed portion of the rack, and wherein the central shaft is configured to facilitate attachment of the guidance element to the housing, thereby simultaneously serving to drive the displacement device along the rack and guide the displacement device during such driving operation.

8. The displacement device as recited in claim 1 wherein the flexible electrical power line is a ribbon cable that extends from a portion of the housing having a plane parallel with a surface of the closure member.

9. The displacement device as recited in claim 1 wherein the housing and a guidance element are adapted to move in the displacement direction along the complete length of the rack.

10. An electrically-operated displacement device for use in effecting displacement of at least one closure member in a motor vehicle body, the device comprising:

a rack disposed within a body portion of the vehicle body in a direction parallel with a displacement direction of the at least one closure member, wherein the rack has a toothed portion extending along one edge of the rack running parallel with the displacement direction;

a housing positioned adjacent to the rack comprising:

an electrical driver;

electrical means for transferring rotating motion from the driver to a shaft mounted within the housing;

a pinion gear attached to the shaft, wherein the pinion gear is engaged with the toothed portion of the rack, whereby rotational movement of the electrical driver causes the housing to be displaced along the rack in the displacement direction; and means for guiding the housing along the rack during operation of the electrical driver, wherein the means for guiding comprise guide surfaces which surround the toothed portion and that are in contact with opposing surface portions of the rack.

11. The displacement device as recited in claim 10 wherein the housing is formed from two half portions that are attached together by releasable locking means.

12. The displacement device as recited in claim 11 wherein the guide surfaces are integral with a housing half portion and are positioned along the housing half portion adjacent the rack.

13. The displacement device as recited in claim 12 wherein the means for guiding includes a guidance element that extends a distance from a portion of the housing adjacent the rack, wherein the guidance element includes guidance surfaces facing toward the housing, and wherein the rack is interposed between the guide surfaces of the housing and the guidance element.

14. The displacement device as recited in claim 13 wherein the guidance element is attached to the housing by a threaded portion of the shaft that extends from the housing, through a hole in the guidance element and is secured by a nut.

15. The displacement device as recited in claim 13 comprising at least one closure member attachment extending from a surface portion of the housing, wherein the closing member attachment is configured to accommodate placement of an edge portion of the at least one closure member therein.

16. The displacement device as recited in claim 13 wherein the rack is configured having a surface having at least one non-planer section when viewed in the displacement direction.

17. The displacement device as recited in claim 16 comprising attachment points at opposite ends of the rack defining the displacement direction to accommodate attachment of the rack to adjacent portions of the vehicle body, wherein the attachment points are not planer with the toothed portion of the rack.

18. The displacement device as recited in claim 17 wherein the housing and the guidance element are adapted to move in the displacement direction along the rack past the attachment points.

19. The displacement device as recited in claim 18 wherein the housing and the guidance element are adapted to move in the displacement direction along the rack along a complete length of the rack.

* * * * *

UNITED STATES PATENT AND TRADEMARK OFFICE

CERTIFICATE OF CORRECTION

PATENT NO. : 5,537,782

DATED : July 23, 1996

INVENTOR(S) : U. Kippert; D. Backert; K. Wagner; K. Leidner; C. Brandt

It is certified that error appears in the above-indentified patent and that said Letters Patent is hereby corrected as shown below:

Column 3, line 8, before "FIG. 2b" insert

Figure 1A:
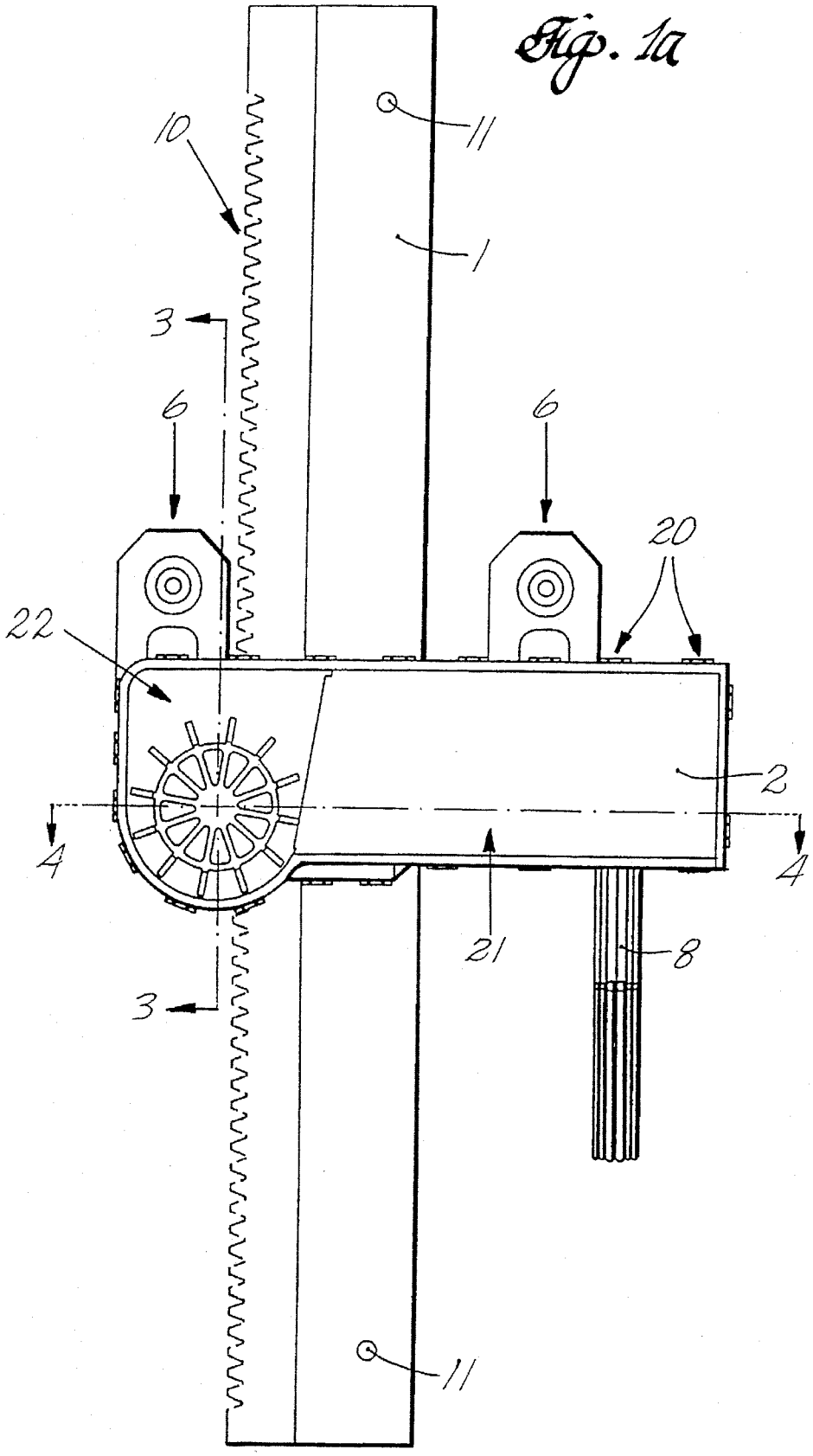
FIG. 1*a* is a front elevational view of a displacement device constructed in accordance with principles of this invention positioned in a horizontal direction, essentially perpendicular to the plane of a window.
Figure 1B:
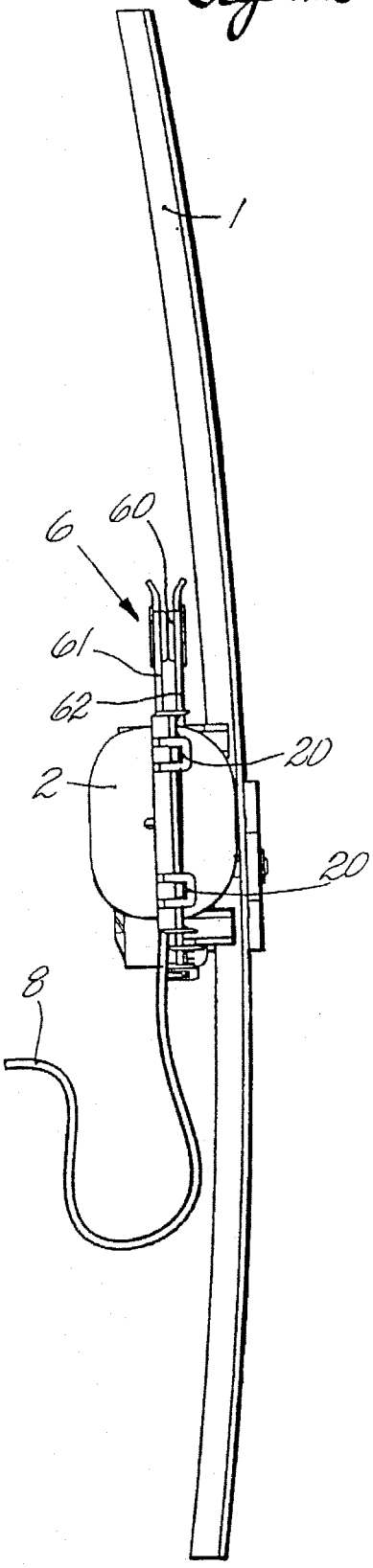
FIG. 1*b* is a side elevational view of the displacement device of FIG. 1*a* (turned clockwise by 90°)
Figure 1C:
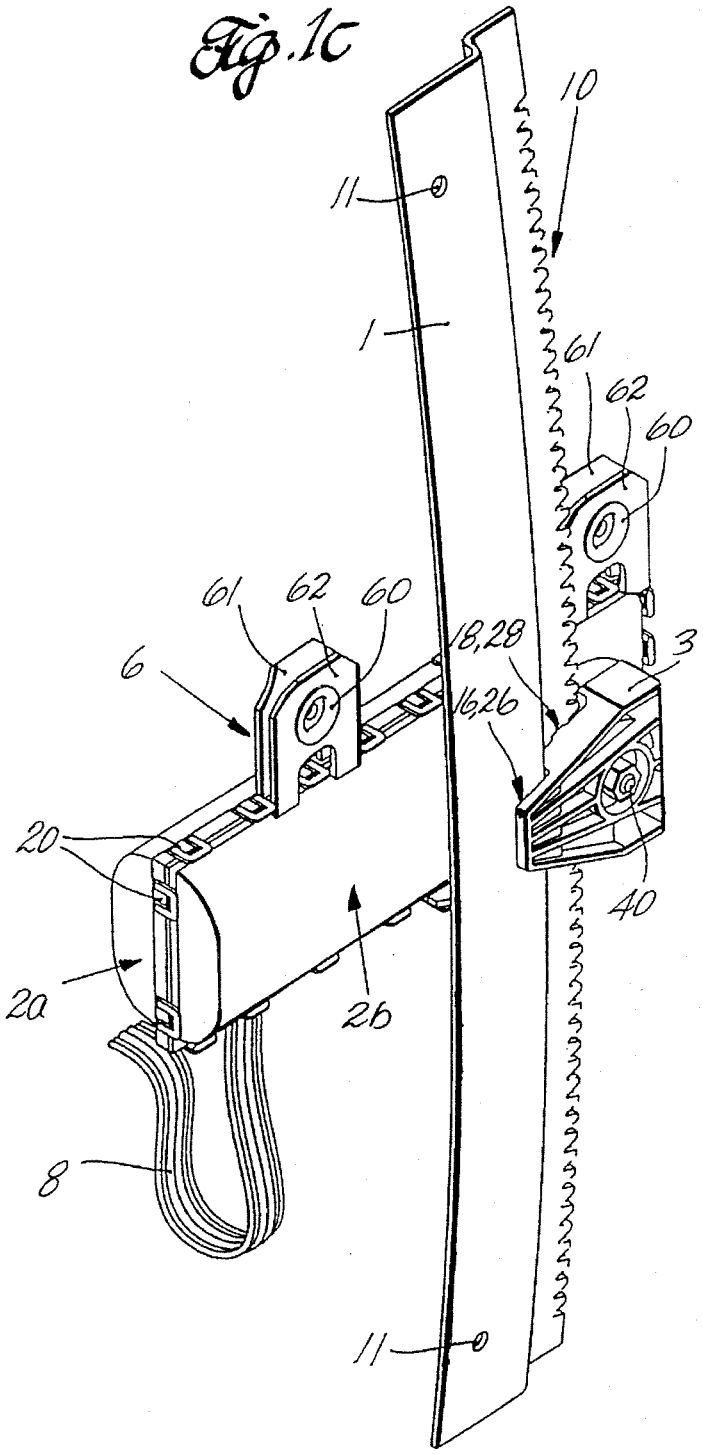

-- FIG. 1c is a perspective view of the displacement device of FIGS. 1a and 1b (turned clockwise by 140° with respect to FIG. 1a);

FIG. 2a is a semi-schematic side elevation of a toothed rack with stamped attachment point constructed according to principles of this invention; --.

Column 7, line 38, before "displacement" change "the" to -- a --.

Signed and Sealed this

Twenty-ninth Day of April, 1997

*Attest:*

Bruce Lehman

BRUCE LEHMAN

*Attesting Officer*

*Commissioner of Patents and Trademarks*